US009528320B2

(12) United States Patent
Winslow et al.

(10) Patent No.: US 9,528,320 B2
(45) Date of Patent: Dec. 27, 2016

(54) ROTARY STEERABLE DRILLING SYSTEM

(71) Applicant: HALLIBURTON ENERGY SERVICES, INC., Houston, TX (US)

(72) Inventors: Daniel Martin Winslow, Spring, TX (US); Neelesh V. Deolalikar, Webster, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 196 days.

(21) Appl. No.: 14/390,145

(22) PCT Filed: Nov. 25, 2013

(86) PCT No.: PCT/US2013/071734

§ 371 (c)(1),
(2) Date: Oct. 2, 2014

(87) PCT Pub. No.: WO2015/076850

PCT Pub. Date: May 28, 2015

(65) Prior Publication Data

US 2016/0222734 A1 Aug. 4, 2016

(51) Int. Cl.
*E21B 7/06* (2006.01)
*E21B 7/04* (2006.01)
(Continued)

(52) U.S. Cl.
CPC . *E21B 7/04* (2013.01); *E21B 3/00* (2013.01); *E21B 4/006* (2013.01); *E21B 7/062* (2013.01); *E21B 7/067* (2013.01)

(58) Field of Classification Search
CPC ..... E21B 7/04; E21B 7/06; E21B 7/062
See application file for complete search history.

(56) References Cited

U.S. PATENT DOCUMENTS 5,113,953 A 5/1992 Noble
5,265,682 A 11/1993 Russell et al.
(Continued)

OTHER PUBLICATIONS

International Search Report and Written Opinion of the International Searching Authority issued in International Application No. PCT/US2013/071734 on Aug. 21, 2014; 12 pages.
(Continued)

*Primary Examiner* — Giovanna C Wright
(74) *Attorney, Agent, or Firm* — Alan Bryson; Parker Justiss, P.C.

(57) ABSTRACT

A rotary steerable drilling system includes a gear box driven by a driveshaft having an input rotatable in a first direction and an output rotatable in an opposite direction. An output of the gear box has a first axis of rotation, and a rotatable tubular bit sleeve annularly arranged around a distal portion of the driveshaft is pivotable to have a second axis of rotation and includes a connector assembly on a distal end of the bit sleeve for coupling the bit sleeve to a drill bit. A spherical CV joint couples the bit sleeve to the drive-shaft, eccentric cams are movably positioned on the driveshaft, a differential gearing system is connected to the eccentric cams, and a pressure applying device is connected to the eccentric cams. When activated, the pressure applying device applies pressure to modify the speed of rotation of the eccentric cams. A method of rotary steerable drilling is disclosed.

23 Claims, 4 Drawing Sheets

(51) Int. Cl.
*E21B 4/00* (2006.01)
*E21B 3/00* (2006.01)

(56) References Cited

U.S. PATENT DOCUMENTS

| | | | | |
|---|---|---|---|---|
| 5,520,255 | A | 5/1996 | Barr et al. | |
| 5,695,015 | A | 12/1997 | Barr et al. | |
| 6,092,610 | A * | 7/2000 | Kosmala | E21B 4/20 175/27 |
| 6,116,355 | A | 9/2000 | Thorp et al. | |
| 6,158,529 | A | 12/2000 | Dorel | |
| 7,188,685 | B2 | 3/2007 | Downton et al. | |
| 7,413,032 | B2 | 8/2008 | Krueger | |
| 7,481,281 | B2 | 1/2009 | Schuaf | |
| 7,556,105 | B2 | 7/2009 | Krueger | |
| 7,810,585 | B2 | 10/2010 | Downton | |
| 7,866,415 | B2 | 1/2011 | Peters | |
| 7,931,098 | B2 | 4/2011 | Aronstam et al. | |
| 7,987,927 | B2 | 8/2011 | Downton | |
| 2005/0126826 | A1 | 6/2005 | Moriarty et al. | |
| 2008/0135292 | A1 | 6/2008 | Sihler et al. | |
| 2008/0142264 | A1 | 6/2008 | Hall et al. | |
| 2008/0190665 | A1 | 8/2008 | Earles et al. | |
| 2011/0162891 | A1 * | 7/2011 | Camp | E21B 7/067 175/61 |
| 2013/0319764 | A1 * | 12/2013 | Schaaf | E21B 7/06 175/24 |
| 2015/0368973 | A1 * | 12/2015 | Gajji | E21B 4/006 175/61 |

OTHER PUBLICATIONS

Halliburton, "Geo-Pilot® Rotary Steerable System," H02157-A4, Jul. 2014, 6 pages.
Schlumberger "PowerDrive Orbit," 13-DR-0250, 2014, 8 pages.
Schlumberger "PowerDrive Archer," 13-Dr-0004, 2013, 7 pages.
Halliburton, "Geo-Pilot® XL Rotary Steerable System," H05677, Dec. 2013, 6 pages.
Halliburton, "EZ-Pilot® Rotary Steerable System," H04622-A4, Aug. 2012, 2 pages.
Schlumberger "PowerDrive X6," 10-DR-0233, 2010, 6 pages.
Schlumberger "PowerDrive Xceed," 07-DR-051, 2010,7 pages.
Baker Hughes, "AutoTrak Services," 30217, 2010, 12 pages.
Schlumberger "PowerDrive vorteX," 08-DR-103, 2008, 7 pages.
Gygrodata, "Well-Guid RSS™: Rotary Steerable System 10-300 Series," Gyrodata Service Catalog, 2007, 4 pages.

* cited by examiner

ROTARY STEERABLE DRILLING SYSTEM

CLAIM OF PRIORITY

This application is a U.S. National Stage of International Application No. PCT/US2013/071734, filed Nov. 25, 2013.

TECHNICAL FIELD

This invention relates to a rotary steerable system for directional drilling.

BACKGROUND

Rotary steerable systems (RSS) are devices that direct a downhole drill bit in a desired direction while the drill string is being rotated for the purpose of controlling the path that a well bore makes. The rotary steerable tools are generally programmed by an engineer or directional driller who transmits commands using surface equipment (typically using either pressure fluctuations in the mud column or variations in the drill string rotation) which the RSS tools understand and gradually steer the drill bit in the desired direction. In a rotary steerable system, the bottom hole assembly ("BHA") trajectory is deflected while the drill string continues to rotate. Rotary steerable systems have a biasing mechanism to bias the drill string into a desired trajectory. The biasing mechanism may either be a push-the-bit type, which exerts a force on a drive-shaft by pushing off the formation, or a point-the-bit type, which changes the angle of the bit axis by directly pushing on a driveshaft. In one example of a push-the-bit RSS, a group of expandable thrust pads extend laterally from the BHA to thrust and bias the drill string into a desired trajectory. For this to occur while the drill string is rotated, the expandable thrust pads extend from what is known as a geostationary portion of the drilling assembly. Geostationary components of the RSS are rotated at a roughly equal but opposite direction as the drill string, so that the geostationary components do not rotate relative to the formation while the remainder of the drill string is rotated. By maintaining the geostationary portion in a substantially consistent orientation, the operator at the surface may direct the remainder of the bottomhole assembly (BHA) into a desired trajectory relative to the position of the geostationary portion with the expandable thrusters.

To maintain a geostationary portion of the drill string with a net zero rotation relative to the formation, motion counter to the rotation of the drill string is generated resulting in a net zero rotation relative to the formation. Typically the geostationary section is created by a type of device that physically engages the formation to prevent rotation. These types of tools have an external geostationary housing that is mounted on bearings. In other cases drilling fluid flow is used to counter rotate the geostationary portion of the RSS. The drilling fluid flow is directed across a turbine or mud motor that turns in the target direction. Various devices, such as a continuously variable transmission, or electromagnetic clutches engaged to the counter rotating turbine are used to adjust speed of the counter rotating member. However, in all of these devices the input flow rate is based on other fluctuating drilling parameters and may not provide a consistent source of power for a counter rotating member of the geostationary portion of the RSS. Additionally, if the rotating motion of the drill string is not constant, which occurs during stick slip drilling conditions in a wellbore, the target tool face (or direction in which the drill string is being steered at a given time) cannot be maintained.

DESCRIPTION OF DRAWINGS

Like reference symbols in the various drawings indicate like elements.

DETAILED DESCRIPTION

Rotary steerable systems (RSS) are devices that direct a downhole drill bit in a desired direction while the drill string is being rotated for the purpose of controlling the path that a well bore makes. An RSS includes a mechanism for measuring a reference direction with respect to gravity, and a mechanism for steering with respect to the measured direction. A mechanical member of the RSS is "geostationary", or effectively stationary with respect to gravity (e.g., stationary with respect to the formation). In many RSS systems the geostationary member is external and has a mechanism to engage the well bore to prevent rotation. Other RSS systems have an internal counter rotating mechanism that cancels out the rotation of the drill string.

The RSS of this disclosure provides a mechanism for controlling a rotary steerable tool which allows the rotary steerable tool to track a target direction with limited or without feedback control, and allows for a simple method to adjust the target direction. With the RSS of this disclosure, the target tool face (or direction in which the drill string is being steered at a given time) is directly, rigidly connected to the rotation of a driveshaft and maintained regardless of the motion. This feature advantageously makes the tool less susceptible to changing downhole conditions while drilling. This mechanism also requires very little electrical or hydraulic power to actuate the tool, as compared to traditional systems. The mechanism described in this disclosure is compact and reliable.

Figure 1:
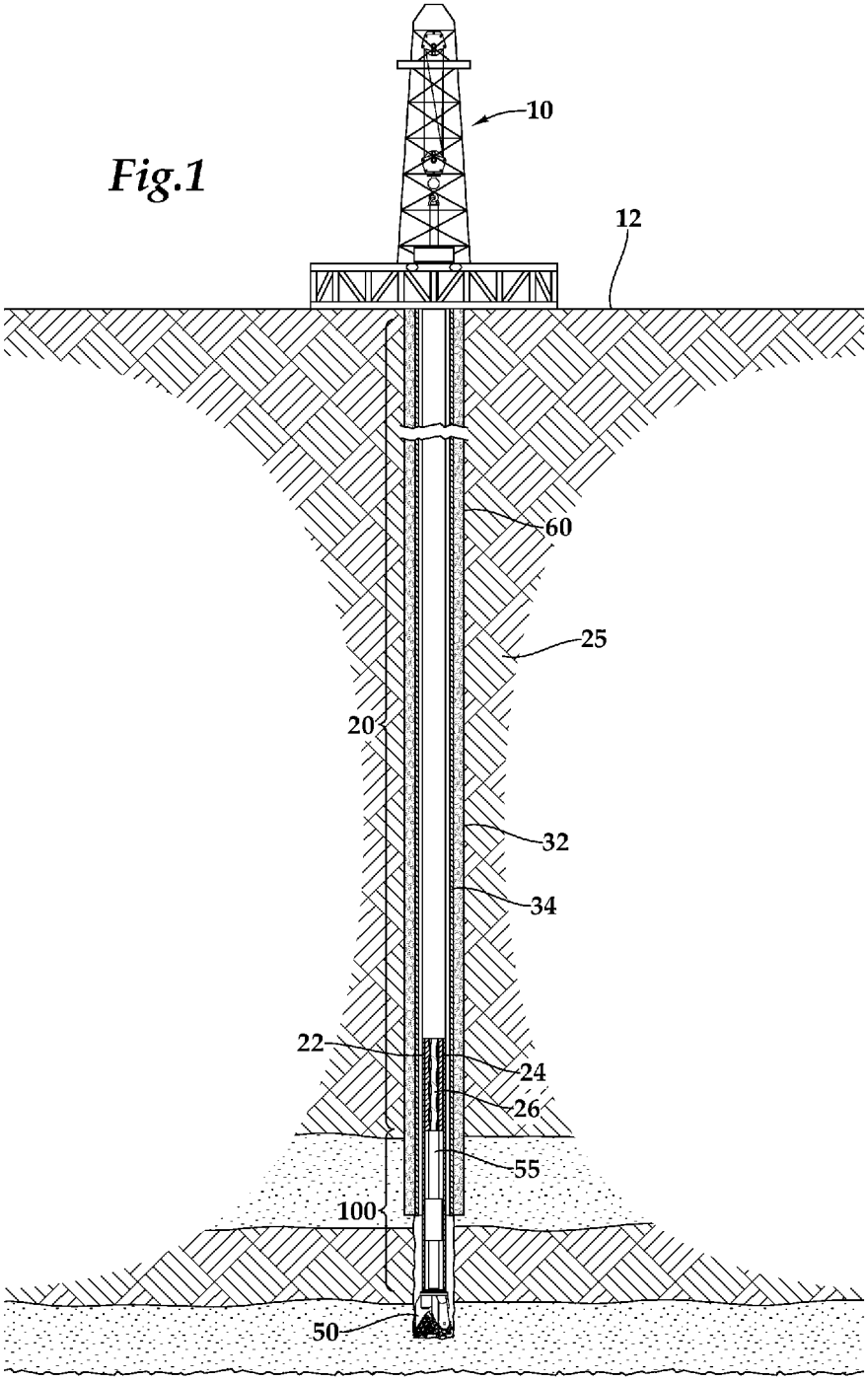
FIG. 1 is a schematic illustration of a drilling rig and downhole equipment including a rotatory steerable system disposed in a wellbore.

As shown in FIG. 1, in general, a drilling rig 10 located at or above a surface 12 rotates a drill string 20 disposed in a well bore 60 below the surface. The surface equipment on the drilling rig rotates the drill string 20 and the drill bit 50 as it bores into the Earth's geologic formations 25 to form the well bore 60. The well bore 60 may be reinforced by a casing 34 and a cement sheath 32 in the annulus between the casing 34 and the borehole. In the implementation of FIG. 1, the drill string 20 includes a power section 22 (e.g., a positive displacement mud motor) that includes a stator 24 and a rotor 26. A rotatable driveshaft 55 element of the RSS 100 (see FIGS. 2 and 3) is coupled to the drill string 20 and transfers torque via the RSS 100 down the borehole to a drill bit 50 or other downhole equipment.

The RSS 100 of this disclosure transfers torque from the power section 22 of the drill string 20 to the drill bit 50 and the RSS steers the drill bit 50 located at the downhole end of the RSS 100 drill.

Figure 2:
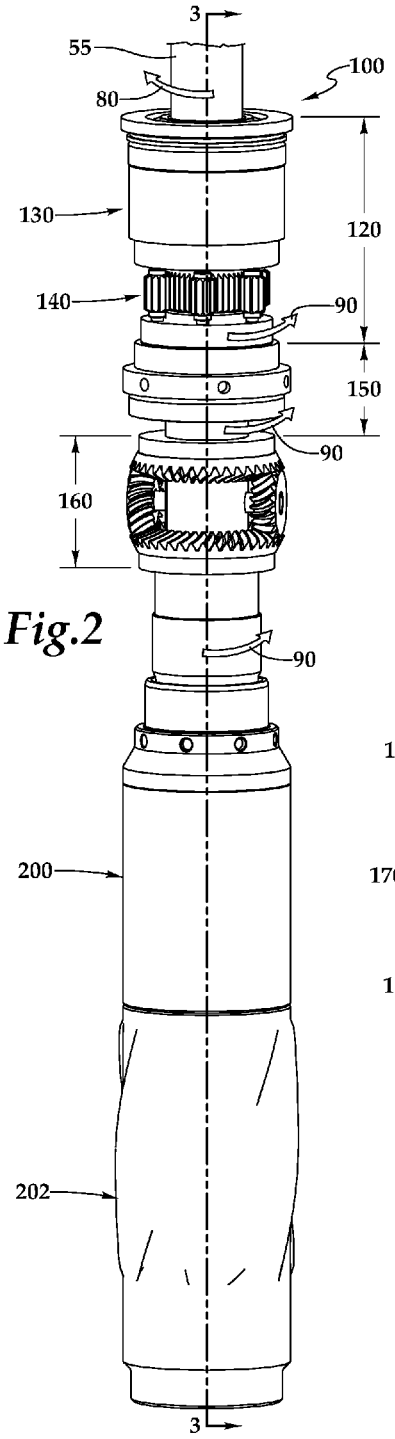
FIG. 2 is a side view of a portion of a driveshaft coupled to a rotatory steerable system, with a stationary housing removed.
Figure 2A:
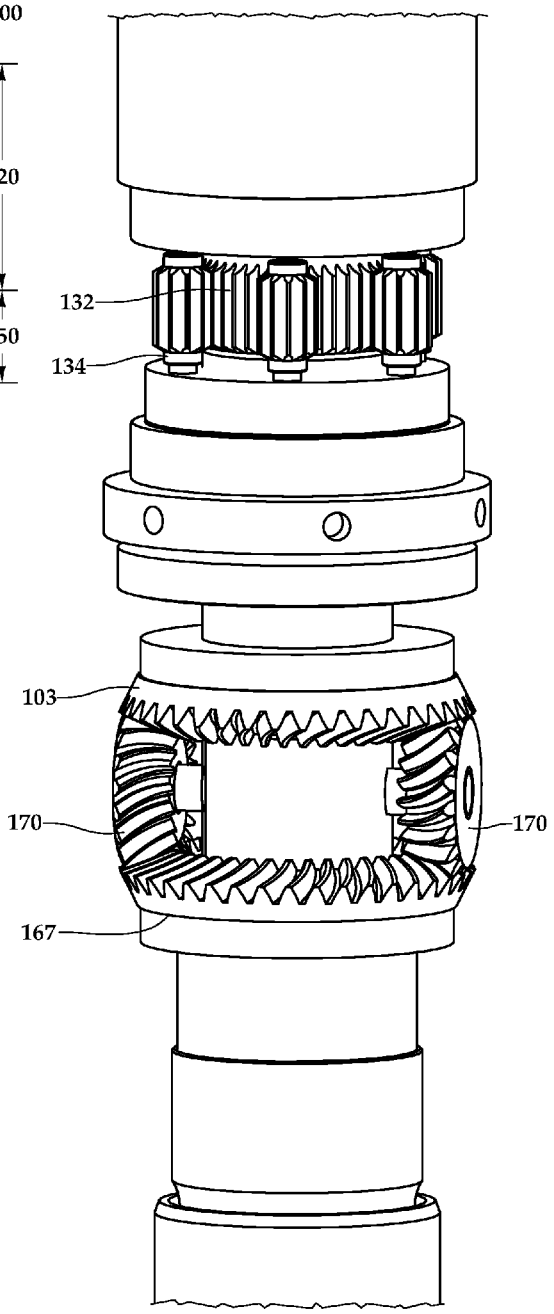
FIG. 2A is an enlarged partial side view of FIG. 2 with the exterior housing shown in phantom lines.

Referring to FIG. 2, the rotation of the rotatable driveshaft 55 provides a rotational input in a first rotary direction 80 to a rotary input of a two-stage planetary gearbox 120, including a first planetary gearbox 130 and a second planetary gearbox 140. A rotary output of the two-stage planetary gearbox 120 provides rotational motion in a second rotary direction equal to or substantially equal in speed, but opposite in direction from the first rotary direction. This opposite rotation creates a geostationary member which can be used to steer the drill bit 50. A differential gearing system 160 is also included to allow the geostationary non-rotating member to increase or decrease its speed by a specific amount for changing the target drilling direction.

Figure 3:
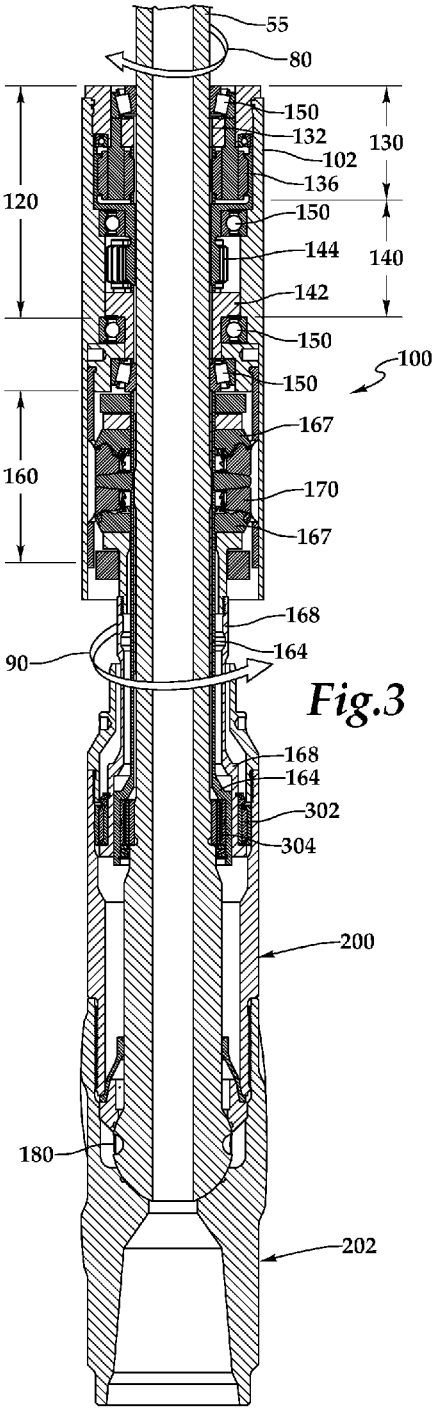
FIG. 3 is a cross sectional view of the rotatory steerable system of FIG. 2.
Figure 3A:
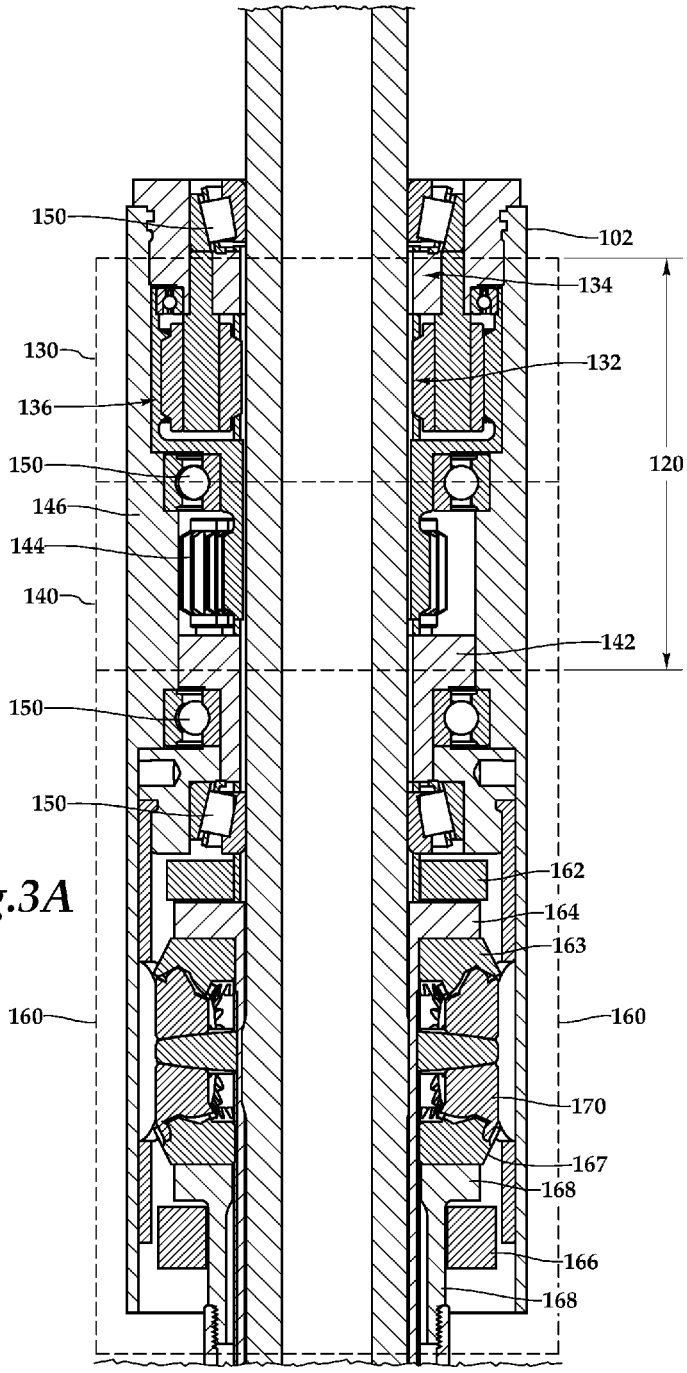
FIG. 3A is an enlarged cross sectional view of an uphole portion of the rotatory steerable system of FIG. 3.

Referring in particular to FIGS. 3 and 3A (which are cross sections of the RSS of FIG. 2), the RSS 100 works to change the direction of the drill bit 50 by using the rotary motion of the driveshaft 55 itself. The entire driveshaft 55 is rotating to the right in a first rotary direction 80 (or clockwise as seen from the surface). As the driveshaft 55 rotates, the rotary motion of the driveshaft 55 is transferred to a rotary input of the two-stage planetary gearbox 120. The first stage 130 of the planetary gearbox 120 has as rotary input comprising a sun gear 132 and a rotary output comprising a planet carrier 134 fixed to an annular stationary housing 102 and a ring gear 136. This first planetary gearbox 130 reverses the direction of rotation 80 (see FIG. 2) from the right, or clockwise, to the left, or a second rotary direction being counterclockwise 90, and slightly increases the speed. In one implementation, the sun gear of stage one may have 40 teeth; each of the planet gears has 10 teeth; the ring gear has 72 teeth.

The output speed from the first planetary gearbox 130 is slightly different than the input speed; this speed differential is corrected by a second planetary gearbox 140. The second planetary gearbox 140 is also connected to the annular stationary housing 102. The second planetary gearbox 140 has a sun gear 144 as an input and the planet carrier 142 as an output also with a ring gear 146 fixed to the stationary housing 102.

The combination of both first and second gearboxes 130, 140 in the two-stage planetary gearbox 120 includes a rotary output that outputs a reversed rotary motion 90 in a second direction that is equal or substantially equal in speed and opposite in direction to the direction 80 of the driveshaft 55. In one implementation the input sun gear for second gearbox two may have 44 teeth; each planet gears have 11 teeth; the ring gear has 66 teeth. The below Table 1 provides data for an exemplary first and second gear box ratios that provide a total gear ratio of 1:−1.

TABLE 1

| Gear Speed—Stage 1 | | | |
|---|---|---|---|
| | Sun | Planet | Ring |
| Number of Teeth | 40 | 16 | 72 |
| Gear Ratio (Sun in Annular Out) | | −2.50 | |
| **Gear strength calculation—Stage 2** | | | |
| | Sun | Planet | Ring |
| Gear Ratio | | .4000000 | |

The reversed rotary motion 90 is then passed through a series of bearings 150 and transferred to the differential gearing system 160. Referring in particular to FIGS. 2 and 3A, the differential gearing system 160 includes eccentric rings, of a type known in the art. The two eccentric rings are connected to an inner cam 164 and an outer cam 168, which are capable of relative rotation by any means such as is known in the art. Relative rotation between the two eccentric rings results in a relative displacement between the center of the outer cam 168 and the center of the inner cam 164. For example, the differential gearing system can be designed such that at zero degrees of rotation, the centers of the two eccentric rings coincide. The cams have a maximum displacement between their centers at 180 degrees of relative rotation. Such a system provides the ability to impart a controlled deflection on the drilling shaft at the location of the assembly.

The reversed and speed matched rotation 90 is an input to the differential gearing system 160. The differential gearing system 160 functions as a typical differential gear unit known in the art, such as employed in the rear-wheel drive of a car that compensates for the differing tire speeds as a car turns a corner and the inside tire turns faster than outside tire. Briefly, typical differential units typically comprise a ring gear which turns a carrier. The carrier is connected to both sun gears through a planet gear. Torque is transmitted to the sun gears through the planet gear. The planet gear revolves around an axis of the carrier, driving the sun gears. If the resistance at both wheels is equal, the planet gear revolves without spinning about its own axis, and both wheels turn at the same rate. However, if one of the sun gears encounters resistance, the planet gear spins as well as revolving, allowing the sun gear with resistance to slow down, with an equal speeding up of the right sun gear. When a vehicle having such a differential unit is traveling in a straight line, there will be no differential movement of the planet gears, but the planets gears slowly rotate when going around a corner.

The differential gearing system 160 is similar to the rear-wheel drive differential unit on a car in function, in that it can output different speeds for different inputs to the mechanism. In this instance, a planet gear 170 is coupled to two sun gears 163, 167. An inner cam solenoid 162 that is annular around the driveshaft 55 and which can apply force to a first cam 164 that is driven by sun gear 163. The second, outer cam solenoid 166 acts on the second cam 168 that is driven by sun gear 167. If one or both of the inner cam solenoid 162 and outer cam solenoid 166 is activated, the speed of either one of the drive 163 for the inner cam 164 or the drive 167 for the outer cam 168 changes. The resulting change in speed to one or both of the two cams 164, 168 changes the speed ratio from equal to some value that is proportional to the load by one or both of the solenoids 162, 166. The difference in speeds between the two cams 164, 168 allows the bend angle to be adjusted, permitting movement of a portion (the tubular bit sleeve 202) of the steering housing 200 in a different direction. This rotation is centered a spherical constant velocity (CV) joint 180 located downhole with respect to the solenoids 162, 166. The tubular bit sleeve 202 may be coupled at a first (proximal) end via the spherical CV joint 180 and coupled at a second (distal) end to a drill bit 50 by a connector assembly. In some implementations the connector at the distal end may be a threaded female connection in the bit sleeve and a mating male threaded connection on the drill bit. In other implementations the connector assembly may include intervening subassemblies between the tubular bit sleeve and the drill bit as known in the art.

The load placed on the differential gearing system 160 by the inner and outer cam solenoids 162, 166 determines which percentage of load goes on the inner and outer cams 164, 168. Inner cam solenoid 162 (uphole of differential gearing system 160 in FIG. 3A) and outer cam solenoid 166 (downhole of differential gearing system 160 in FIG. 3A) energize the inner and outer cams, respectively (equivalent to the passenger vs. driver side in a car). When the inner and outer cam solenoids 162, 166 are not energized then loads on the respective cams are identical; the cams are therefore rotating at equal speeds, being exactly the opposite speed of the driveshaft 55 as output by the two-stage planetary gearbox 120. In the absence of a force by the solenoid 162 and/or 166, the rotary steerable system 100 naturally maintains the target toolface direction. To make an adjustment, a user energizes at least one of the solenoids, which changes the force felt by the cam, and thus the rotation speed. In order to adjust bend setting or steering direction solenoids are used to load one or other side of differential. Alternatively, instead of solenoids a pressure applying device for applying pressure to the cams may be selected from the group of, hydraulic pistons, friction clutches, and actively controlled brakes.

As illustrated in FIG. 3, the rotatable steering housing 200 pivots around the spherical CV joint 180, changing the direction of drilling of the bit sleeve 202. The spherical CV joint 180 transmits power through a variable angle, at constant rotational speed, without an appreciable increase in friction or play. The steering housing 200 has two bearings, one on the outside 302 and one on the inside 304, and the inner and outer cams 164, 168 which are concentric. When the cams are aligned such that their eccentricities are opposite, their effect is cancelling. When aligned so their eccentricities are in same direction, they add together. The effect of the eccentricity is to tilt the steering housing in the direction of eccentricity, so the cams together tilt the bit sleeve 202 around the CV joint 180. In the system described herein, tilt angles from 0 to 1.5 degrees (based on the relative geometry of the cams) are possible.

To tilt in the desired direction, a user would rotate the cams in the appropriate relative position to move the string at varying angles from the vertical (e.g., to the 3 o'clock or 8 o'clock position). To change the bend angle of the steering housing 200, the user varies the magnitude of the offset by varying the force imparted by one or both of the pressure applying devices (e.g. solenoids 162, 166).

In the RSS System 100 of this disclosure, the downhole side of the cam are in the fully rotating section. In prior art RSS systems one or more electric motors drives the cam(s). In the RSS 100, the motors are replaced with the differential gearing assembly 160. Energy from the drill string can be used to turn the cams, instead of using electric energy to turn the electric motors of traditional RSS systems.

The present disclosure includes a method of rotary steerable drilling including one or more of the following steps: positioning a rotary steerable drilling system 100 on a distal end a rotatable drill string 20 (which may include power section 22) in a wellbore 60; rotating an input of a gear box 120 with the rotatable driveshaft 55 in a first rotary direction 80; outputting from the gear box a rotary output 90 in second rotary direction opposite to the first rotary direction; rotating rotary output of the gear box about a first axis of rotation; pivoting with a differential gearing system 160 a rotatable tubular bit sleeve 202 annularly arranged around a distal portion of the driveshaft 55 by activating a first pressure applying device 162 and/or a second pressure applying device 166 connected respectively to a first eccentric cam 164 and a second eccentric cam 168 movably positioned concentrically around the driveshaft 55 wherein pressure applied to each eccentric cam 164 and 168 modifies a respective speed of rotation of each of the eccentric cams 164, 168, thereby pivoting the bit sleeve 202 to a second axis of rotation; and rotating a drill bit attached to a distal end of the bit sleeve 202.

In some implementations the method a rotating an input of a gear box 120 with the rotatable driveshaft 55 in a first rotary direction 80 and outputting a rotary output 90 in second rotary direction opposite to the first rotary direction further comprises: providing a two stage planetary gear box 120 having a first stage planetary gear system 130, wherein said first stage planetary gear system 130 includes a rotary input coupled to the rotatable driveshaft 55 and said two stage gearbox 120 having a second stage planetary gear box 140 having an input coupled to the first stage output; rotating the rotary input of the first stage gear system in a first rotary direction 80 and at first rotary speed, and outputting from the first stage gear system an output in a second rotary direction opposite 90 to the first rotary direction and at a second rotary speed; inputting into the second stage gearing system coupled to the output of the first stage gearing system the output of the first stage gearing system; and outputting from the second stage gearing system an output rotary speed substantially equal to the a first rotary input speed of the first stage gearing system and in an opposite direction 90 from the first rotary input direction 80 of the first stage gearing system.

In some implementations the method further includes energizing either of the pressure applying devices (e.g. the solenoids 162, 166) and there by applying force to their respective cams 164, 168.

A number of embodiments of the invention have been described. Nevertheless, it will be understood that various modifications may be made without departing from the spirit and scope of the invention. For example, in other embodiments, other gearbox types can be used based on the design intent and packaging requirements. For example a set of bevel gears joined by idler planets can be used to create the 1 to −1 drive rotation. If the input gear is connected to the driveshaft with a clutch then input gear could be allowed to slip to reduce the counter rotation speed which would provide a method for changing tool face. This mechanism would lend itself to a concept where the counter rotation is connected to a hydraulic valve which directed hydraulic flow to actuation pistons, or any fix bend mechanism. Although a few method implementations have been described in detail above, other modifications are possible. For example, the process flows described herein do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A rotary steerable drilling system positionable on a rotatable drill string in a wellbore, said rotary steerable system comprising:

a gear box driven by a rotatable driveshaft coupled to the rotatable drill string, said gearbox having a rotary input rotatable in a first rotary direction and a rotary output rotatable in second rotary direction opposite to the first rotary direction;

the rotatable driveshaft having a first axis of rotation;

a pivotable rotatable tubular bit sleeve coupled at a first end to a second end of the rotatable drive-shaft, the bit sleeve pivotable to have a second axis of rotation different than the first axis of rotation of the rotatable driveshaft, said pivotable rotatable tubular bit sleeve including a connector assembly on a distal end of the bit sleeve for coupling the bit sleeve to a drill bit;

eccentric cams movably positioned concentrically around the drive-shaft;

a differential gearing system connected to the eccentric cams; and pressure applying device connected to the eccentric cams, wherein when activated the pressure applying device applies pressure to modify a speed of rotation of the eccentric cams thereby pivoting the bit sleeve to the second axis of rotation.

2. The rotary steerable drilling system of claim 1, wherein a spherical constant velocity joint couples the tubular bit sleeve to the rotatable driveshaft.

3. The rotary steerable drilling system of claim 1, wherein the gearbox comprises a two-stage planetary gear box having a first stage planetary gear system, said first stage having a rotary input coupled to the rotatable driveshaft, said rotary input rotatable in a first rotary direction and a first rotary speed, and said first stage planetary gear system having an output in a second rotary direction opposite to the first rotary direction and at a second rotary speed, said two-stage planetary gearbox having a second stage planetary gear system having an input coupled to the output of the first stage planetary gear system, said second stage planetary gear system having an output in the second rotary direction of the first stage planetary gear system and an output rotary speed substantially equal to the first rotary speed of the first stage planetary gear system.

4. The rotary steerable drilling system of claim 3, wherein a portion of the driveshaft is contained within an annular stationary housing containing the gearbox and differential gearing system.

5. The rotary steerable drilling system of claim 4, wherein the annular stationary housing comprises a geostationary nonrotating section.

6. The rotary steerable drilling system claim 3, wherein the two-stage planetary gearbox has an input to output ratio of 1:−1.

7. The rotary steerable drilling system of claim 1, wherein the pressure applying device is selected from a group consisting of solenoids, hydraulic pistons, friction clutches, and actively controlled brakes.

8. The rotary steerable drilling system of claim 1, wherein the differential gearing system further comprises a first sun gear connected to a drive for an inner cam, and a second sun gear connected to a drive for an outer cam, and the first and second sun gears are connected by a planet gear.

9. The rotary steerable drilling system of claim 8, wherein the pressure applying device comprises a first solenoid connected to the drive for the inner cam, and a second solenoid connected to the drive for the outer cam.

10. The rotary steerable drilling system of claim 9, wherein either of the solenoids impart force to its respective cam drive when the solenoid is energized.

11. The rotary steerable drilling system of claim 9, wherein the eccentric cams are located within a rotatable sleeve.

12. The rotary steerable drilling system of claim 9, wherein the solenoids are annular and disposed around the respective eccentric cams.

13. A method of rotary steerable drilling comprising:

positioning a rotary steerable drilling system on a distal end a rotatable drill string in a wellbore;

rotating an input of a gear box with a rotatable driveshaft in a first rotary direction;

outputting from the gear box a rotary output in second rotary direction opposite to the first rotary direction about a first axis of rotation;

pivoting with a differential gearing system a rotatable tubular bit sleeve annularly arranged around a distal portion of the driveshaft by activating a first pressure applying device and a second pressure applying device connected respectively to a first eccentric cam and a second eccentric cam movably positioned on the drive-shaft, wherein pressure applied to each eccentric cam modifies a respective speed of rotation of each of the eccentric cams, thereby pivoting the bit sleeve to a second axis of rotation; and rotating a drill bit attached to a distal end of the tubular bit sleeve.

14. The method of claim 13 wherein rotating an input of a gear box with the rotatable driveshaft in a first rotary direction and outputting a rotary output in second rotary direction opposite to the first rotary direction further comprises:

providing a two-stage planetary gear box having a first stage planetary gear system, wherein said first stage planetary gear system includes a rotary input coupled to the rotatable driveshaft and said two-stage planetary gearbox-having a second stage planetary gear system having an input coupled to the output of the first stage planetary gear system;

rotating the rotary input of the first stage gear system in a first rotary direction and at first rotary speed, and outputting from the first stage planetary gear system an output in a second rotary direction opposite to the first rotary direction and at a second rotary speed;

inputting into the second stage gear system coupled to the output of the first planetary stage gear system the output of the first stage planetary gear system; and outputting from the second stage gearing system an output rotary speed substantially equal to the first rotary speed of the first stage planetary gear system and in an opposite direction from the first rotary direction of the first stage planetary gear system.

15. The method of claim 14, further including enclosing a portion of the driveshaft and gearing elements in an annular stationary housing.

16. The method of claim 15, wherein the annular stationary housing comprises a geostationary nonrotating section.

17. The method of claim 14, wherein the two-stage planetary gearbox has an input to output ratio of 1:−1.

18. The method of claim 13, wherein the pressure applying device is selected from a group consisting of solenoids, hydraulic pistons, friction clutch, and actively controlled brake.

19. The method of claim 13, wherein the differential gearing system comprises a first sun gear connected to a drive for an inner cam, and a second sun gear connected to a drive for an outer cam, and the first and second sun gears are connected by a planet gear.

20. The method of claim 19, wherein the pressure applying device comprises a first solenoid connected to the drive for the inner cam, and a second solenoid connected to the drive for the outer cam.

21. The method of claim 20, further including energizing either of the solenoids and there by applying force to their respective cam.

22. The method of claim 20, wherein the solenoids are annular and disposed around each respective eccentric cam.

23. The method of claim 13, wherein the eccentric cams are located within a rotatable sleeve.

* * * * *